US007192212B2

(12) United States Patent
Gutberlet et al.

(10) Patent No.: US 7,192,212 B2
(45) Date of Patent: Mar. 20, 2007

(54) APPLICATION DEVICE FOR APPLYING A LIQUID, GEL-LIKE OR PASTY COSMETIC TO THE SKIN

(75) Inventors: Detlev Erich Gutberlet, Altdorf (DE); Lothar Käsmacher, Stolberg (DE)

(73) Assignee: H&M Gutberlet GmbH, Nuremberg (DE)

( * ) Notice: Subject to any disclaimer, the term of this patent is extended or adjusted under 35 U.S.C. 154(b) by 172 days.

(21) Appl. No.: 10/773,454

(22) Filed: Feb. 9, 2004

(65) Prior Publication Data

US 2005/0105956 A1 May 19, 2005

(30) Foreign Application Priority Data

Feb. 8, 2003 (DE) ..... 203 02 008 U

(51) Int. Cl.
*B43K 5/06* (2006.01)
*B43K 1/06* (2006.01)
*A47L 13/30* (2006.01)

(52) U.S. Cl. ..... 401/174; 401/172; 401/263; 401/265

(58) Field of Classification Search ..... 401/68, 401/172–175, 176, 177, 179, 261–267, 75–79
See application file for complete search history.

(56) References Cited

U.S. PATENT DOCUMENTS 5,007,755 A * 4/1991 Thompson ..... 401/175
5,573,341 A * 11/1996 Iaia ..... 401/172
5,725,133 A * 3/1998 Iaia ..... 222/390
5,851,079 A * 12/1998 Horstman et al. ..... 401/174
5,868,510 A * 2/1999 Lacout et al. ..... 401/70
6,155,735 A * 12/2000 Nakajima ..... 401/172
6,746,170 B2 * 6/2004 Delage ..... 401/266

FOREIGN PATENT DOCUMENTS

| | | |
|---|---|---|
| DE | 3538001 | 4/1987 |
| DE | 691 17 513 | 10/1996 |
| DE | 694 02 584 | 12/1997 |
| DE | 697 00 116 | 6/1999 |

OTHER PUBLICATIONS

Patent Abstracts of Japan, Publication No. 2002223846, Aug. 13, 2002, L'Oreal SA, "Stick for Cream-, Gel-, or Paste-Type Product, or the Like".

* cited by examiner

*Primary Examiner*—David J. Walczak
(74) *Attorney, Agent, or Firm*—Browdy and Neimark, PLLC

(57) ABSTRACT

In an application device for applying a liquid, gel-like or pasty cosmetic to the skin, it is provided, with a view to improved handling and simple design, that the application device comprises a container for the cosmetic; an applicator which is connected to the container via at least one supply channel; a piston which is displaceably guided in the container for delivery of the cosmetic towards the applicator; and an operating mechanism for operating the piston.

21 Claims, 4 Drawing Sheets

APPLICATION DEVICE FOR APPLYING A LIQUID, GEL-LIKE OR PASTY COSMETIC TO THE SKIN

BACKGROUND OF THE INVENTION

1. Field of the Invention

The invention relates to an application device for applying a liquid, gel-like or pasty cosmetic to the skin.

2. Background Art

Application devices of the generic type are known from prior public use. The known application devices are still in need of improvement of handling and simplicity of design.

SUMMARY OF THE INVENTION

It is an object of the invention to embody an application device of improved handling and simple design.

According to the invention, this object is attained in an application device comprising a container for the cosmetic; an applicator which is connected to the container via at least one supply channel; a piston which is displaceably guided in the container for delivery of the cosmetic towards the applicator; and an operating mechanism for operating the piston.

The invention provides an application device which is comprised of few components of clearly defined function. This simplifies the handling and simultaneously reduces manufacturing requirements.

When the piston comprises an outer guide section of non rotationally symmetic, cross-sectional shape, the guide section cooperating with a complementary inner guide surface of the container, this way of guidance of the piston in the application device offers the possibility of saving an additional component that functions as a guide in the application device. This reduces the manufacturing requirements.

Elliptic piston guidance, with the cross-sectional shape of the outer guide section being elliptic, can be manufactured at a low cost, the piston being guided without tending to tilting on the one hand and sufficiently guarded against undesirable twisting on the other hand.

Cosmetics can be accurately and/or finely dosed when the operating mechanism is rotatable about the longitudinal axis of the piston, and translation of the rotary motion of the operating mechanism into piston travel takes place via a reversing gear, in particular a helical gear, with a locking device being provided, which subdivides the rotary motion of the operating mechanism about the longitudinal axis into discrete steps of rotation.

The locking device comprises a first locking unit which is disposed on the operating mechanism and cooperates with a second locking unit which is mounted on another part of the application device, in particular on the container, one of the two locking units having at least one rib which cooperates with at least one flexible locking tongue of the other locking unit. A locking device of this type can be manufactured at a low cost. For example, the locking units can be integrally molded on the corresponding components of the application device.

The at least one locking tongue is formed for deviation from the symmetry of rotation about the longitudinal axis of the piston such that the locking device permits a motion of rotation of the operating, mechanism only in a single direction of rotation. This precludes undesirable maloperation of the application device. In particular, it prevents impurities or dust particles from being sucked into the application device.

A flexible interlocking device enables the operating mechanism to be safely connected to the application device, the operating mechanism being in particular guarded against any undesirable axial motion relative to the other components of the application device. It reduces the risk of cosmetic escaping from the application device by undesirable removal of the operating mechanism.

The interlocking device comprises a flexible interlocking element which is provided on an outer wall of the operating mechanism and which, for flexible dislocation, is disposed in the vicinity of a wall weakening of the operating mechanism. Such an interlocking device is easy to fabricate, nevertheless offering sufficient interlocking flexibility. Weakening the wall can take place for example by weakening windows being provided in the area of a hollow portion of the operating mechanism. Weakening can also be put into practice by the wall thickness of the operating mechanism being reduced in the area of the flexible interlocking element.

The applicator has a flocked application surface which is integrally joined thereto. Such an application surface leads to an application device that consists of a reduced number of parts, the flocked application surface being an integral component of the applicator.

Details of the invention will become apparent from the ensuing description of an exemplary embodiment, taken in conjunction with the drawing.

BRIEF DESCRIPTION OF THE DRAWING

FIG. 1 is a longitudinal sectional view of an application device according to the invention with a cap placed on;

DESCRIPTION OF A PREFERRED EMBODIMENT

Figure 1:
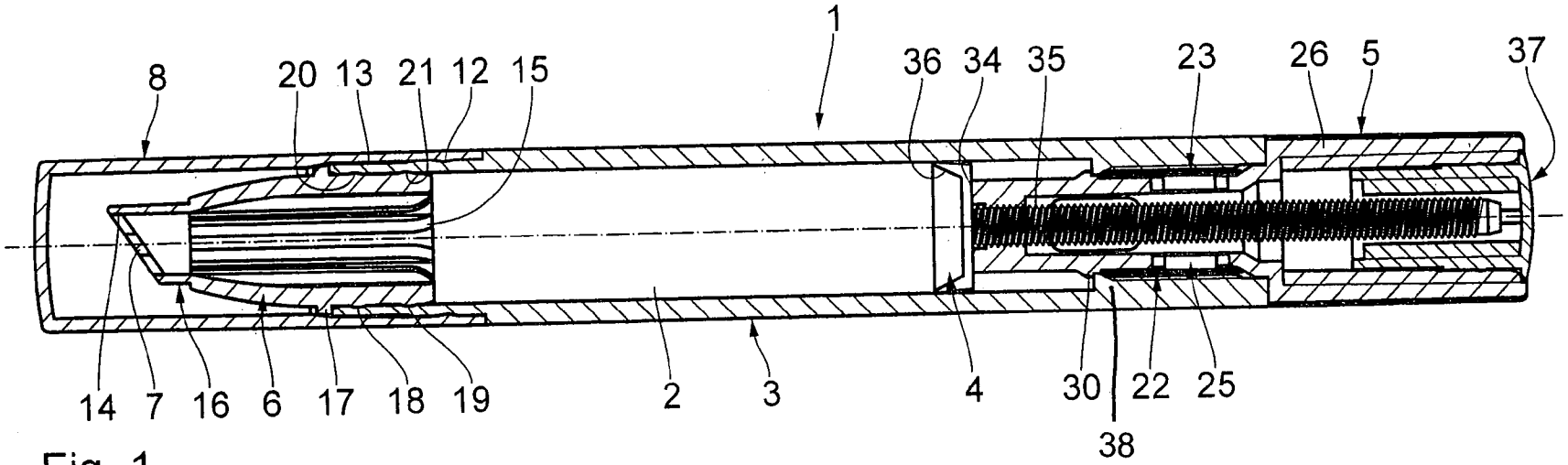

FIG. 1 is a longitudinal sectional view of an application device, which is designated in its entirety by 1, for applying a liquid, gel-like or pasty cosmetic to the skin. The cosmetic is located in a reservoir 2 of a substantially tubular or sleeve-type container 3 of a transparent polypropylene copolymer. For application purposes, the cosmetic is squeezed out of the reservoir 2 and through an applicator 6 by means of a piston 4 which is movable by the aid of an operating mechanism 5 so that the cosmetic is available on an application surface 7 of the applicator 6.

Figure 2:
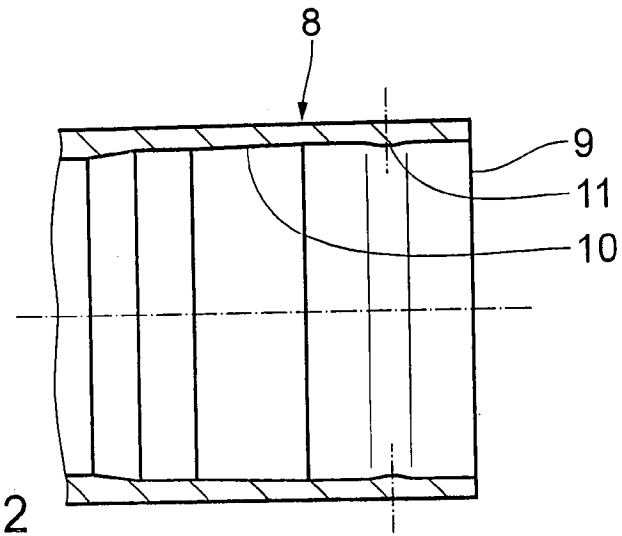
FIG. 2 is a detailed view, on an enlarged scale, of the cap of FIG. 1 in the vicinity of a circumferential locking nose.
Figure 8:
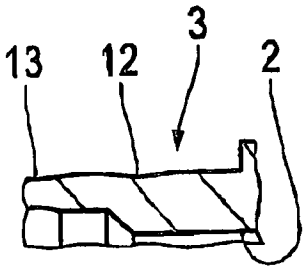
FIG. 8 is a detailed view, on an enlarged scale, on the container of FIG. 5 in the vicinity of a circumferential locking notch for engagement with the circumferential locking nose of the cap.
Figure 7:
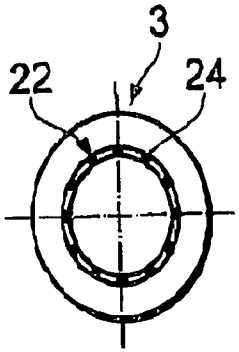
FIG. 7 is a plan view of the container of FIG. 5 seen in a direction from the operating mechanism of the application device.

FIG. 2 shows a detail, on an enlarged scale, of a cap 8 with which to cover the applicator 6 when the application device 1 is not in use. In vicinity to an opening 9 of the cap 8, a circumferential locking nose 11 is integrally formed on an inside wall 10 of the cap 8. Instead of the locking nose 11, provision can be made for several locking segments which are distributed along the circumference. When the cap 8 closes the application device 1, the circumferential locking nose 11 is accommodated in a complementary circumferential locking notch 12 on the outer wall 13 of the container 3 (see FIG. 8). The cap 8 is also made of a transparent polypropylene copolymer, yielding upon placement on the container 3 in such a way that the circumferential locking nose 11 can slip into the circumferential locking notch 12.

Figure 4:
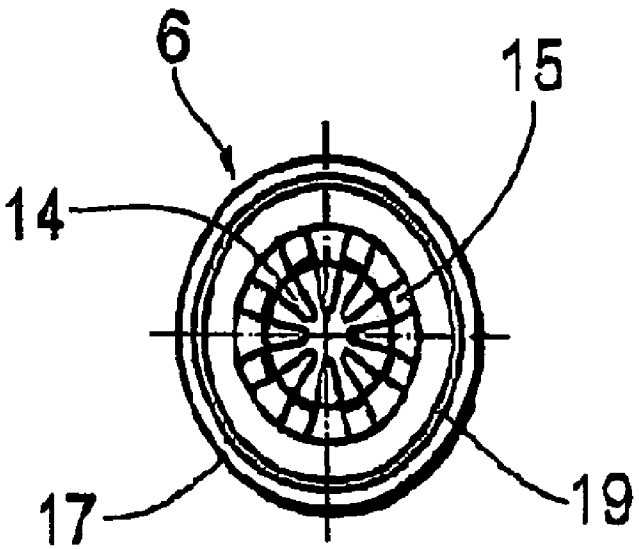
FIG. 4 is a plan view of the applicator of FIG. 3 seen in the opposite direction from a cosmetic container of the application device.
Figure 3:
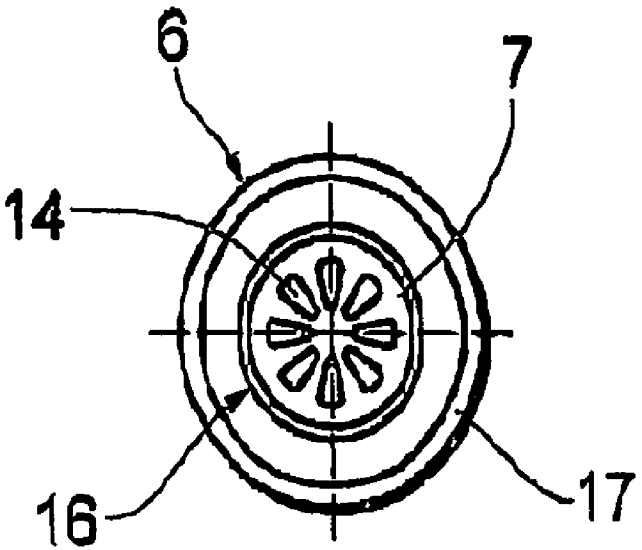
FIG. 3 is a plan view of an applicator of the application device of FIG. 1, showing an application surface.

FIGS. 3 and 4 show further details of the applicator 6. FIG. 3 is a plan view of the application surface 7 of the applicator 6. The application surface 7 comprises a total of eight supply channels 14 which are arranged radially uniformly in the circumferential direction and through which cosmetic can be supplied when the application device 1 is used. The width of the supply channels 14 exceeds 1 mm. This helps prevent clogging of the supply channels 14 in particular when the applicator 6 is dipped into liquid glue.

The applicator 6 is made integrally from a polyester-based thermoplastic elastomer (TEEE).

In a direction towards the reservoir 2, the supply channels 14 unite in the substantially hollow applicator 6. For guidance of the cosmetic when it is squeezed through, the applicator 6 comprises a total of eight guiding ribs 15 between the reservoir 2 and the application surface 7; the ribs 15 extend in the longitudinal direction and are uniformly distributed in the circumferential direction. The guiding ribs 15 serve in particular for reduction of the dead volume inside the applicator 6.

Following the inclined application surface 7, the outer contour of the applicator 6 is cylindrical in the vicinity of an application head 16, then expanding stepwise and becoming convex steadily towards a stepped circumferential collar 17. By a surface that is turned away from the application head 16, the circumferential collar 17 bears against a leading front wall of the container 3. Following the circumferential collar 17, the outer wall of the applicator 6 is provided with two circumferential locking noses 18, 19 which are disposed axially one after the other and engage with complementary circumferential locking notches 20, 21 on the inside wall of the container, preventing the applicator 6 from axially slipping out of the container 3.

The outer wall of the application head 16, inclusive of the application surface 7, is coated with flock. As compared to the rest of the applicator 6, the application head 16 is thin-walled and therefore flexible and fitting snugly.

Figure 6:
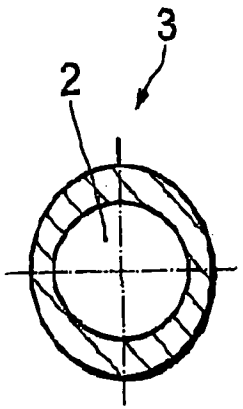
FIG. 6 is a sectional view on the line VI—VI of FIG. 5.
Figure 5:
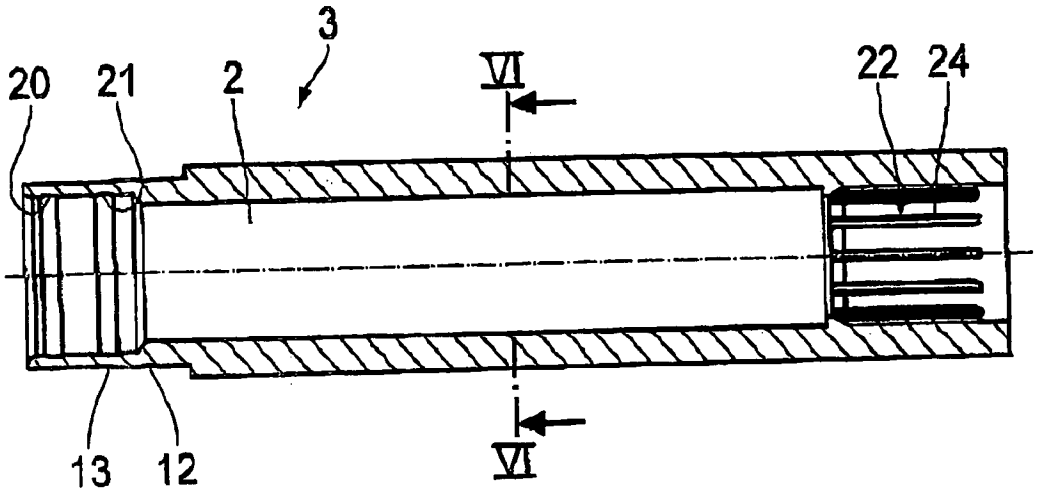
FIG. 5 is a longitudinal sectional view of the container of the application device of FIG. 1.
Figure 9:
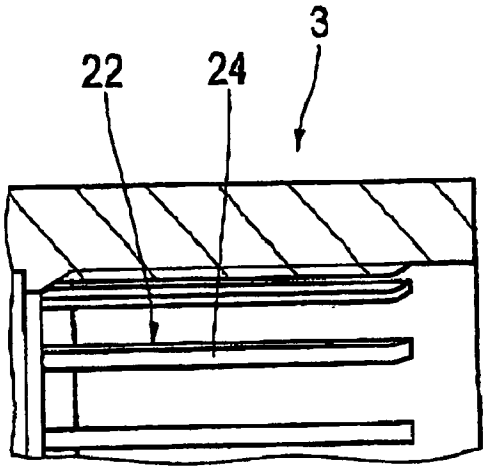
FIG. 9 is a detailed view, on an enlarged scale, of the container of FIG. 5 in the vicinity of a locking unit that cooperates with the operating mechanism.
Figure 10:
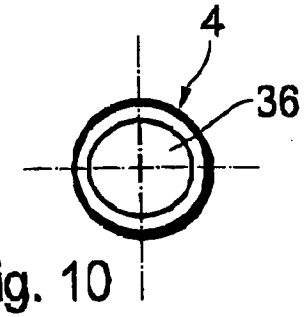
FIG. 10 is a plan view of a piston of the application device of FIG. 1.

FIGS. 5 to 9 illustrate further details of the container 3. In the vicinity of the reservoir 2, the container 3 has an elliptic cross-sectional shape as seen in FIG. 6. As seen in FIG. 10, the outer contour of the piston 4 is complementary thereof. Therefore, the piston 4 can slide through the container 3 in the area of the reservoir 2, only moving in the direction of the longitudinal axis of the container 3 and not rotating as a result of the elliptic piston 4 being guided in the complementarily elliptic reservoir 2.

On the side that faces away from the receptacle of the applicator 6, the container 3 comprises a locking unit 22 following the reservoir 2. The locking unit 22 is part of a locking device 23 by means of which a rotary motion of the operating mechanism 5 about the longitudinal axis thereof is subdivided into discrete rotary steps for finely dosing the cosmetic. To this end the locking unit 22 has a total of twelve ribs 24 which are uniformly distributed in the circumferential direction, extending in the longitudinal direction of the container 3.

Within the locking device 23, the locking unit 22 of the container 3 cooperates with another locking unit 25 which is integrally molded on the operating mechanism 5.

Figure 11:
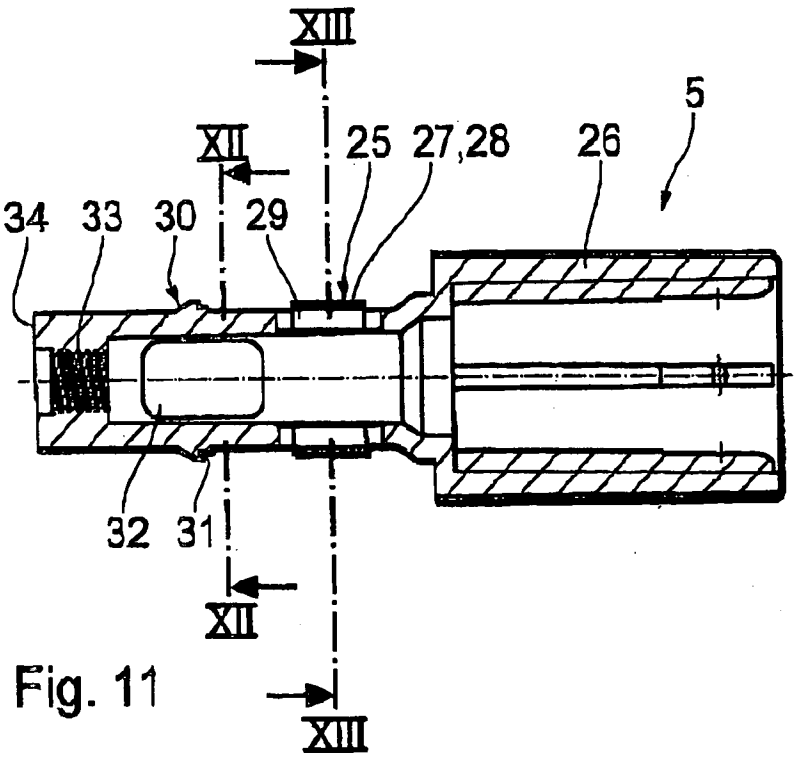
FIG. 11 is a longitudinal sectional view of the operating mechanism of the application device of FIG. 1, with a plug being omitted.
Figure 13:
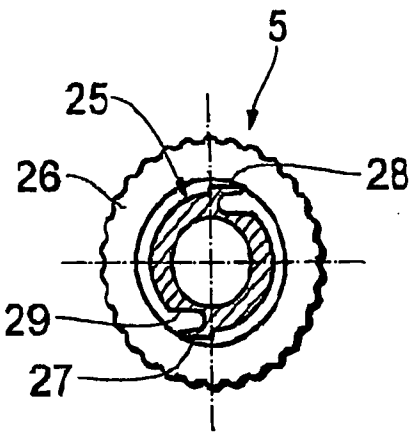
FIG. 13 is a sectional view on the line XIII—XIII of FIG. 11.
Figure 12:
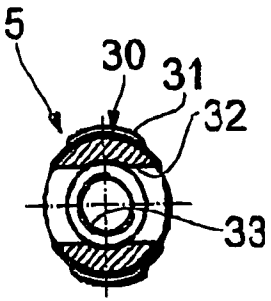
FIG. 12 is a sectional view on the line XII—XII of FIG. 11.

FIGS. 11 to 13 illustrate further details of the operating mechanism 5. It is substantially designed as a sleeve and hollow inside. It is made from a mix of styrene-acrylonitrile (SAN) and acrylonitrile/butadiene/styrene (ABS). The operating element of the operating mechanism 5 is a turning knob 26 which is lengthwise corrugated outside and by means of which a user can rotate the operating mechanism 5 about the longitudinal axis thereof. In the direction towards the reservoir 2, the operating mechanism 5 tapers by a step and an ensuing conical surface, which is followed by the locking unit 25 of the operating mechanism 5.

The locking unit 25 comprises two locking tongues 27 which extend in the longitudinal direction of the operating mechanism 5 and are displaced from one another by 180° in the circumferential direction about the longitudinal axis of the operating mechanism 5. In the illustration of FIG. 13, the locking tongues 27 taper off clockwise, forming locking edges 28. In the radial direction towards the longitudinal axis of the operating mechanism 5 and below the locking edges 28, weakening recesses 29 are provided in the basic body of the operating mechanism 5, extending axially of the longitudinal axis thereof, so that the locking edges 28 of the tongues 27 can flexibly yield inwards.

On the side that faces away from the turning knob 26, following the locking unit 25 and a cylindrical portion, the outer wall of the operating mechanism 5 passes into flexible, circumferential locking-collar sections 30 by a circumferential step 31. When the application device 1 is assembled, the flexible locking-collar sections 30 bear by the circumferential step 31 against a corresponding circumferential step 38 of the container 3 between the reservoir 2 and the locking unit 22.

On a level with the flexible, circumferential locking-collar sections 30, the wall of the operating mechanism 5 is weakened by two weakening windows 32 in the shape of rectangles with rounded corners.

Following the flexible locking-collar sections 30 in the direction towards the reservoir 2, the cylindrical inside wall of the operating mechanism 5 passes by a circumferential step into an internally threaded section 33. In the direction towards the reservoir 2, the operating mechanism 5 ends in a frontal stop face 34; a wall of the piston 4 which is turned away from the reservoir 2 rests on the frontal stop face 34 in a limit-of-travel position of the piston 4 seen in FIG. 1. A circumferential edge of the piston 4 rests on the inside wall of the container 3 which defines the reservoir 2. The circumferential edge tapers off in the shape of a wedge towards the reservoir 2. Upon travel of the piston 4, the cosmetic in the reservoir 2 exerts pressure on the circumferential edge which is forced against the inside wall of the container 3, sealing towards it.

A threaded rod 35, which is molded on the piston 4 as a unit, is complementary of the internally threaded section 33. The piston 4 consists of polyoxymethylene (POM). An area 36 of the piston 4 that is turned towards the reservoir 2 is substantially cup-shaped.

When assembled as seen in FIG. 1, the turning knob 26 of the operating mechanism 5 is closed by a plug 37.

In combination with the internally threaded section 33 of the operating mechanism 5, the threaded rod 35 constitutes a helical gear as a special case of a reversing gear by which to translate the motion of rotation of the operating mechanism 5 about the longitudinal axis thereof into a travel of the piston 4 in the reservoir 2 for delivery of the cosmetic. The internally threaded section 33 and the threaded rod 35 are left-handed threads.

The application device 1 is assembled as follows:

First the piston 4 with the threaded rod 35 is pushed into the container 3 until the piston-4 stop face, which is opposite the piston area 36, bears against the circumferential step 38 inside the container 3 between the reservoir 2 and the locking unit 22. From the other side of the container 3, threaded section 33 of the operating mechanism 5 is then screwed on the threaded rod 35 of the piston 4.

This screwing job is continued until the stop face 34 of the operating mechanism 5 rests on the piston 4, further screwing then being no longer possible. Then the operating mechanism 5 is inserted into the container 3 until the flexible locking-collar sections 30 reach behind the circumferential step 38 in the container 3 between the reservoir 2 and the locking unit 22. During this insertion job, the flexible locking-collar sections 30 can yield inwards due to the weakening windows 32 provided in the operating mechanism 5.

Subsequently, the container 3 is filled with the cosmetic. The applicator 6 is then pushed into the container 3 until the circumferential locking noses 18, 19 of the applicator 6 snap-engage with the circumferential locking notches 20, 21 of the container 3. Finally, the cap is placed over the applicator 6 on the container 3 until the circumferential locking nose 111 of the cap 8 snap-engages with the circumferential locking notch 12 of the container 3. Finally, the plug 37 is pushed into the operating mechanism 5.

In the limit-of-travel position of the piston 4 seen in FIG. 1, an interspace remains between the free end, turned away from the piston 4, of the threaded rod 35 and a front wall on the side of the end of the plug 37.

The application device 1 is used as follows:

For applying the cosmetic to the skin, the turning knob 26 of the operating mechanism 5 is rotated clockwise. In doing so, the locking edges 28 of the locking tongues 27 of the locking unit 25 of the operating mechanism 5 ratchet across the corresponding ribs 24 of the locking unit 22 of the container 3, this ensuring fine dosing of the cosmetic in defined steps on the one hand and tactile dosing feedback to the user on the other hand. Afterwards the dosed cosmetic which, upon dosing, has been squeezed through the supply channels 14 of the application surface 7 is spread on the user's skin. This spreading job is supported by the flocking on tile application head 16 of the applicator 6.

Dosing can be continued until the piston 4 reaches a second limit-of-travel position in which the threaded rod 35 has virtually entirely left the internally threaded section 33. In this second limit-of-travel position, there is still a distance between the piston area 36 and the applicator 6. When the application device 1 has been emptied in this way, it can be recycled.

With corresponding dimensioning of the thread pitch and the cross-sectional area of the piston, a dosing job can be put into practice in which for example a single ratcheting step corresponds to an output of 0.0025 ml of cosmetic through the supply channels 14.

The circumferentially asymmetric design of the locking tongues 27 ensures simple rotation of the turning knob 26 about the longitudinal axis of the operating mechanism 5 to be possible only in one direction of rotation. Upon rotation in the opposite direction, the locking tongues 27 stand up when coming into contact with the ribs 24, any rotation in the opposite direction being rather difficult or not possible at all.

In the foregoing, the application device has been described, taken in conjunction with the application of a cosmetic. Alternative media which can be applied by the application device 1 are for example adhesives, oils, correction fluids, highlighting fluids, desinfection agents, wound closure preparations and lots of other preparations of corresponding consistence, with the applicator being adapted to the respective product that is applied and to the respective field of application.

What is claimed is:

1. An application device (1), in particular for applying a liquid, gel-like or pasty cosmetic to the skin, comprising a container (3) for the cosmetic;

an applicator (6) which is connected to the container (3) via at least one supply channel (14);

a piston (4) which is displaceably guided in the container (3) for delivery of the cosmetic towards the applicator (6);

an operating mechanism (5) for operating the piston (4), the operating mechanism comprising a threaded rod 35) having an end thereof molded on the piston (4) so that the threaded rod and piston form an integral unit;

wherein the operating mechanism (5) is connected and secured to the container (3), via a flexible interlocking device (30, 31);

wherein the interlocking device (30, 31) comprises a flexible interlocking element (30) which is provided on an outer side of a wall of the operating mechanism (5), and an internally threaded section (33) rotatably engaged to the threaded rod (35) formed on an inner side of the wall of the operating mechanism (5), wherein the flexible interlocking element (30) for flexible dislocation, is disposed in the vicinity of a wall weakening (32) of the operating mechanism (5).

2. The application device according to claim 1, wherein the piston (4) comprises an outer guide section of non rotationally, symmetric cross-sectional shape, the guide section cooperating with a complementary inner guide surface (2) of the container (3).

3. The application device according to claim 2, wherein the cross-sectional shape of the outer guide section is elliptic.

4. The application device according to claim 1, wherein the operating mechanism (5) is rotatable about the longitudinal axis of the piston (4), translation of the rotary motion of the operating mechanism (5) into piston travel taking place via a reversing gear, a locking device (23) being provided, which subdivides the rotary motion of the operating mechanism (5) about the longitudinal axis into discrete steps of rotation.

5. The application device according to claim 4, wherein the locking device (23) comprises a first locking unit (25) which is disposed on the operating mechanism (5) and cooperates with a second locking unit (22) which is mounted on the container (3), one of the two locking units (22, 25) having at least one rib (24) which cooperates with at least one flexible locking tongue (27) of the other locking unit (25, 22).

6. The application device according to claim 4, wherein the operating mechanism (5) is rotatable about the longitudinal axis of the piston (4), translation of the rotary motion of the operating mechanism (5) into piston travel taking place via a helical gear (33, 35).

7. The application device according to claim 4, wherein the locking device (23) comprises a first locking unit (25) which is disposed on the operating mechanism (5) and cooperates with a second locking unit (22) which is mounted on the container (3), one of the two locking units (22, 25) having at least one rib (24) which cooperates with at least one flexible locking tongue (27) of the other locking unit (25, 22).

8. The application device according to claim 7, wherein the at least one locking tongue (27) is formed for deviation from the symmetry of rotation about the longitudinal axis of the piston (4) such that the locking device (23) permits a motion of rotation of the operating mechanism (5) only in a single direction of rotation.

9. The application device according to claim 1, wherein the applicator (6) has a flocked application surface (7) which is integrally joined thereto.

10. The application device according to claim 1, wherein the operating mechanism (5) is connected and secured to the container (3).

11. An application device (1), in particular for applying a liquid, gel-like or pasty cosmetic to the skin, comprising a container (3) for the cosmetic;

an applicator (6) which is connected to the container (3) via at least one supply channel (14);

a piston (4) which is displaceably guided in the container (3) for delivery of the cosmetic towards the applicator (6);

an operating mechanism (5) for operating the piston (4);

wherein the operating mechanism (5) is connected and secured to the container (3) via a flexible interlocking device (30, 31);

wherein the interlocking device (30, 31) comprises flexible locking-collar sections as a flexible interlocking element (30) which is provided on an outer side of a wall of the operating mechanism (5), and which, for flexible dislocation, is disposed on a level with weakening windows (32) forming a wall weakening (32) spaced apart from and between opposite ends of the operating mechanism (5).

12. An application device (1), in particular for applying a liquid, gel-like or pasty cosmetic to the skin, comprising a container (3) for the cosmetic;

an applicator (6) which is connected to the container (3) via at least one supply channel (14);

a piston (4) which is displaceably guided in the container (3) for delivery of the cosmetic towards the applicator (6);

an operating mechanism (5) for operating the piston (4);

wherein the operating mechanism (5) is connected and secured to the container (3) via a flexible interlocking device (30, 31);

wherein the interlocking device (30, 31) comprises a flexible interlocking element (30) which is provided on an outer wall of the operating mechanism (5), and which, for flexible dislocation, is disposed in the vicinity of a wall weakening (32) of the operating mechanism (5), wherein the operating mechanism is rotatable about the longitudinal axis of the piston (4), translation of the rotary motion of the operating mechanism (5) into the piston travel taking place via a reversing gear, a locking device (23) being provided, which subdivides the rotary motion of the operating mechanism (5) about the longitudinal axis into discrete steps of rotation, wherein the locking device (23) comprises a first locking unit (25) which is disposed on the operating mechanism (5) and cooperates with a second locking unit (22) which is mounted on the container (3), one of the two locking units (22, 25) having a plurality of ribs (24) which cooperates with two flexible locking tongues (27) of the other locking unit (25, 22), wherein the two locking tongues (27) extend in the longitudinal direction of the operating mechanism (5) and are displaced from one another by 180° in the circumferential direction about the longitudinal axis of the operating mechanism (5).

13. An application device (1), in particular for applying a liquid, gel-like or pasty cosmetic to the skin, comprising a container (3) for the cosmetic;

an applicator (6) which is connected to the container (3) via at least one supply channel (14);

a piston (4) which is displaceably guided in the container (3) for delivery of the cosmetic towards the applicator (6);

an operating mechanism (5) for operating the piston (4), the operating mechanism comprising a threaded rod (35) having an end thereof molded on the piston (4) so that the threaded rod and piston form an integral unit;

wherein the operating mechanism (5) is connected and secured to the container (3), via a flexible interlocking device (30, 31);

wherein the interlocking device (30, 31) comprises a flexible interlocking element (30) which is provided on an outer side of a wall of the operating mechanism (5), an internally threaded section (35) rotationally engaged to the threaded rod (35) formed on an inner side of the wall of the operating mechanism (5), wherein the flexible interlocking element (3) for flexible dislocation, is disposed in the vicinity of a wall weakening (32) of the operating mechanism (5), wherein the internally threaded section (33) is rotatably engaged to the threaded rod (35) at a first end of the operating mechanism (5) and the wall weakening (32) is formed by window openings (32) on opposite sides of the operating mechanism (5) spaced apart from and between the first end and a second end of the operating mechanism (5) and adjacent to the flexible interlocking device (30, 31).

14. The application device according to claim 13, wherein the operating mechanism (5) is rotatable about the longitudinal axis of the piston (4), translation of the rotary motion of the operating mechanism (5) into piston travel taking place via a reversing gear, a locking device (23) being provided, which subdivides the rotary motion of the operating mechanism (5) about the longitudinal axis into discrete steps of rotation.

15. The application device according to claim 14, wherein the operating mechanism (5) is rotatable about the longitudinal axis of the piston (4), translation of the rotary motion of the operating mechanism (5) into piston travel taking place via a helical gear (33, 35).

16. The application device according to claim 14, wherein the locking device (23) comprises a first locking unit (25) which is disposed on the operating mechanism (5) and cooperates with a second locking unit (22) which is mounted on the container (3), one of the two locking units (22, 25) having at least one rib (24) which cooperates with at least one flexible locking tongue (27) of the other locking unit (25, 22).

17. The application device according to claim 16, wherein the at least one locking tongue (27) is formed for deviation from the symmetry of rotation about the longitudinal axis of the piston (4) such that the locking device (23) permits a motion of rotation of the operating mechanism (5) only in a single direction of rotation.

18. The application device according to claim 13, wherein the applicator (6) has a flocked application surface (7) which is integrally joined thereto.

19. The application device according to claim 13, wherein the piston (4) comprises an outer guide section of non rotationally, symmetriccross-sectional shape the guide section cooperating with a complementary inner guide surface (2) of the container.

20. The application device according to claim 19, wherein the cross-sectional shape of the outer guide section is elliptic.

21. The application device according to claim 13, wherein the operating mechanism (5) is connected and secured to the container (3).

* * * * *